US005194780A

United States Patent [19]

Meyer

[11] Patent Number: 5,194,780

[45] Date of Patent: Mar. 16, 1993

[54] ELECTRON SOURCE WITH MICROTIP EMISSIVE CATHODES

[75] Inventor: Robert Meyer, St Nazaire Les Eymes, France

[73] Assignee: Commissariat A L'Energie Atomique, Paris, France

[21] Appl. No.: 703,684

[22] Filed: May 31, 1991

[30] Foreign Application Priority Data

Jun. 13, 1990 [FR] France ..... 90 07347

[51] Int. Cl.[5] ..... G09G 3/10

[52] U.S. Cl. ..... 315/169.3; 315/169.4; 313/309; 313/336

[58] Field of Search ..... 315/35, 169.1, 169.3, 315/169.4; 313/308, 309, 336, 351, 497

[56] References Cited

U.S. PATENT DOCUMENTS 3,735,183 5/1973 Walters ..... 315/169.1
3,998,678 12/1976 Fusake et al. ..... 313/336 X
4,020,381 4/1977 Oess et al. ..... 313/351 X
4,098,536 3/1990 Meyer ..... 313/309 X
4,575,765 3/1986 Hirt ..... 315/169.3 X
4,721,885 1/1988 Brodie ..... 315/576
4,957,161 8/1989 Borel et al. ..... 313/309 X
5,075,591 12/1991 Holmberg ..... 313/495

OTHER PUBLICATIONS

Patent Abstracts of Japan, vol. 13, No. 259, (E-773) (3607) 15 Jun. 1989 & JP-A-O 154 639 (Matsushita), 2 Mar. 1989.

*Primary Examiner*—Eugene R. LaRoche
*Assistant Examiner*—Son Dinh
*Attorney, Agent, or Firm*—Pearne, Gordon, McCoy & Granger

[57] ABSTRACT

Electron source with microtip emissive cathodes having grating-like electrodes. These electrodes can either be cathode conductors (5) or grids (10). Specific application to the excitation of a display screen.

17 Claims, 3 Drawing Sheets

FIG.1
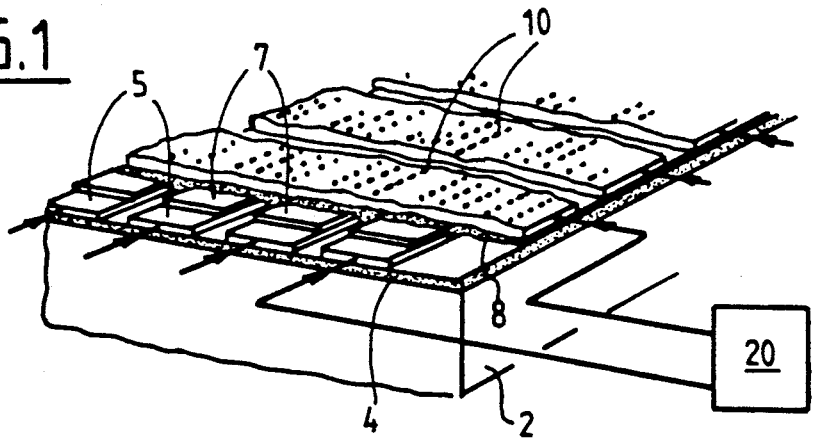
FIG.2
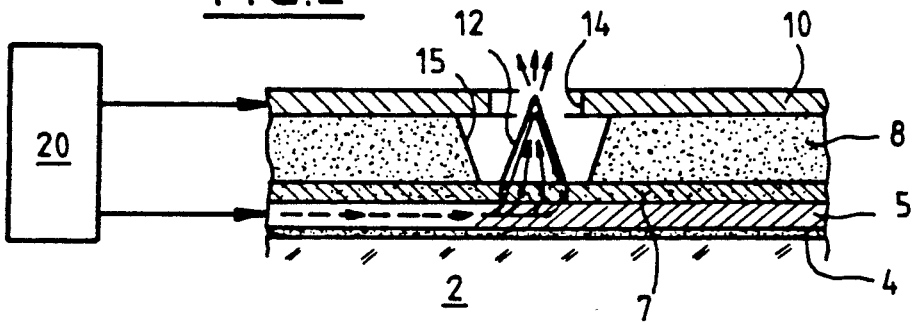
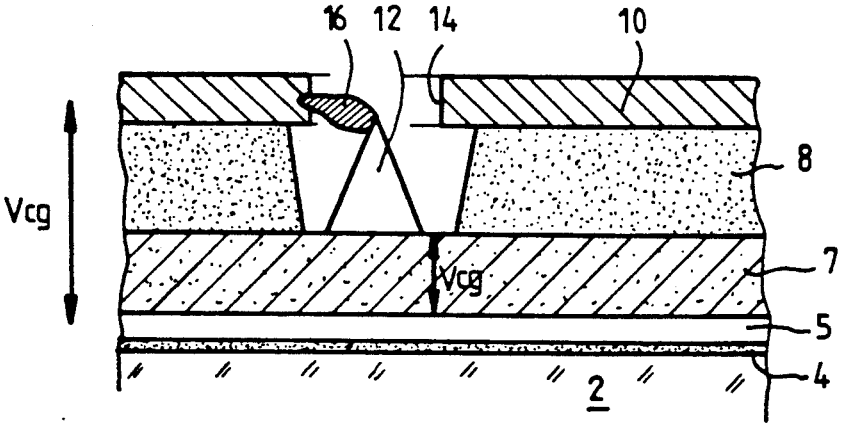
FIG.3
FIG. 4
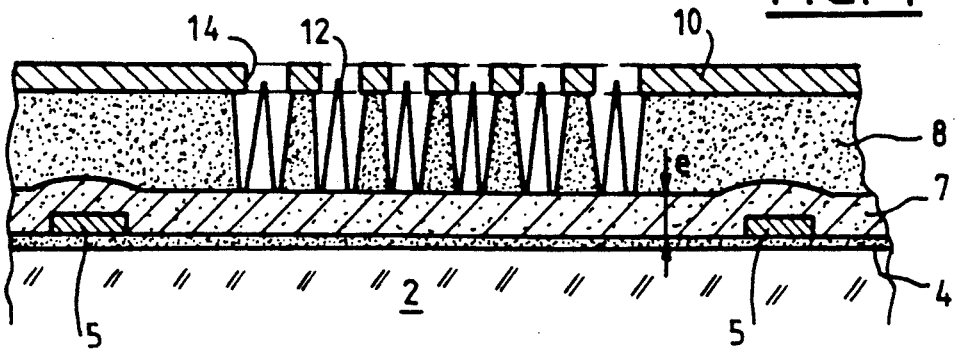

ELECTRON SOURCE WITH MICROTIP EMISSIVE CATHODES

BACKGROUND OF THE INVENTION

The present invention relates to a microtip emissive cathode electron source and to its production process. It more particularly applies to the production of flat display screens.

French patents 2 593 953 and 2 623 013 disclose display means by cathodoluminescence excited by field emission and which incorporate a microtip emissive cathode electron source.

FIG. 1 diagrammatically shows a known microtip emissive cathode electron source described in detail in French patent 2 623 013. This source has a matrix structure and optionally comprises on an e.g. glass substrate 2, a thin silica film 4. On the latter are formed a plurality of electrodes 5 in the form of parallel conductive strips serving as cathode conductors and constituting the columns of the matrix structure. Each of the cathode conductors is covered by a resistive coating 7, which can be continuous (except at the ends in order to permit the connection of the cathode conductors to the polarizing means 20).

An electrically insulating layer 8, made from silica, covers the resistive coating 7. Above the insulating layer 8 are formed a plurality of electrodes 10, once again in the form of parallel conductive strips. These electrodes 10 are perpendicular to the electrodes 5 and serve as grids, which constitute the rows of the matrix structure.

The known source also has a plurality of elementary electron emitters (microtips), one of which is diagrammatically shown in FIG. 2. In each of the intersection zones of the cathode conductors 5 and the grids 10, the resistive coating 7 corresponding to said zone supports e.g. molybdenum microtips 12 and the grid 10 corresponding to said zone has an opening 14 facing each of the microtips 12. Each of the latter substantially adopts the shape of a cone, whose base rests on the coating 7 and whose apex is level with the corresponding opening 14. Obviously, the insulating layer 8 also has openings 15 permitting the passage of the microtips 12.

For information, the following orders of magnitude are given:

thickness of insulating layer 8: 1 micrometer,
thickness of a grid 10: 0.4 micrometer,
diameter of an opening 14: 1.4 micrometer,
diameter of a base of a microtip 12: 1.1 micrometer,
thickness of a cathode conductor 5: 0.2 micrometer,
thickness of a resistive coating: 0.5 micrometer.

The essential object of the resistive coating 7 is to limit the current in each emitter 12 and consequently homogenize the electron emission. In an application to the excitation of spots (pixels) of a display screen, this makes it possible to eliminate excessively bright dots.

The resistive coating 7 also makes it possible to reduce breakdown risk at the microtips 12 through limiting the current and thus preventing the appearance of short-circuits between rows and columns.

Finally, the resistive coating 7 allows the short-circuiting of a few emitters 12 with a grid 10, the very limited leakage current (a few $\mu$A) in the short-circuits does not disturb the operation of the remainder of the cathode conductor. Unfortunately, the problem caused by the appearance of short-circuits between the microtips and a grid is not solved in a satisfactory manner by a device of the type described in French patent 2 623 013.

FIG. 3 diagrammatically shows a microtip. A metal particle 16 causes a short-circuit of the microtip 12 with a grid 10 and in this case all the voltage applied between the grid 10 and the cathode conductor 5 (Vcg approximately 100 V) is transferred to the terminals of the resistive coating 7.

In order to be able to accept a few short-circuits of this type, which are virtually inevitable due to the very large number of microtips, the resistive coating 7 must be able to withstand a voltage close to 100 V, which requires its thickness to exceed 2 $\mu$m. In the opposite case, it would lead to a breakdown due to the heat effect and a complete short-circuit would appear between the grid and the cathode conductor making the electron source unusable.

SUMMARY OF THE INVENTION

The present invention obviates this disadvantage. It aims at improving the breakdown resistance of an electron source having microtip emissive cathodes, said improvement being obtained without increasing the thickness of the resistive source.

In order to achieve this objective, the invention recommends the use of electrodes (e.g. cathode conductors) in a grating form such that these electrodes and the associated resistive coatings are substantially in the same plane. In this configuration, the breakdown resistance is no longer dependent (primarily) on the thickness of the resistive coating, but instead on the distance between the cathode conductor and the microtip. It is therefore sufficient to maintain a sufficient distance between the cathode conductor and the microtip to prevent breakdown, while still retaining a homogenization effect for which the resistive coating is provided.

More specifically, the present invention relates to an electron source incorporating, on an insulating support, a first series of parallel electrodes serving as cathode conductors and carrying a plurality of microtips made from an electron emitting material and a second series of parallel electrodes, serving as grids and which are electrically insulated from the cathode conductors and forming an angle therewith, which defines intersection zones of the cathode conductors and the grids, the grids having openings respectively facing the microtips.

Each of the electrodes of at least one of the series has a grating structure in contact with a resistive coating.

In a preferred manner, the electrodes having a grating structure are metallic and are, for example of Al, Mo, Cr, Nb, etc. It also has an improved conductivity. In a preferred manner, the size of a mesh of the grating is less than the size of an intersection zone. Advantageously, an intersection zone covers several grating meshes.

This assists the operation of the electron source for two reasons:

a) The nominal current per mesh decreases as the number of meshes increases. When the cathode conductors have a grating structure, the access resistance of a cathode conductor to all the microtips of a mesh can be accepted in proportion to the number of meshes, which makes it possible to reduce the leakage current in the case of a short circuit. Thus, the access resistance is not very dependent on the size of the mesh and the number of microtips per mesh. It is mainly dependent on the resistivity and thickness of the resistive coating.

b) The larger the number of meshes within an overlap zone, the less the non-operation (short-circuit) of a mesh disturbs the operation of the electron source. In the case of an application to the excitation of a screen, only a fraction of a pixel is extinguished for a defective mesh, which is not visible on the screen.

The meshes of the grating can have a random shape and can, for example, be rectangular or square. According to a preferred embodiment, the grating meshes are square. According to a variant, the cathode conductors have a grating-like structure.

In this case, advantageously, the microtips occupy the central regions of the grating meshes. This arrangement makes it possible to provide an adequate distance between a cathode conductor and the microtips to prevent breakdown.

According to a development of this variant, each cathode conductor is covered by a resistive coating. According to another development, a resistive coating is inserted between the insulating support and each cathode conductor.

The resistive coating can be made from a material such as indium oxide, tin oxide or iron oxide. Preferably, the resistive coating is of doped silicon.

Whatever material is chosen, it is necessary to ensure that the latter has a resistivity adapted to the homogenization and short-circuit protection effects. This resistivity generally exceeds $10^2$ Ωcm, whereas the resistivity of the cathode conductor is generally below $10^{-3}$ Ωcm.

In another constructional variant, the grids have a grating structure. In this case, the cathode conductors may or may not have a grating structure. The resistive coating is no longer necessary, but can still be present in order to maintain a homogenization effect.

In a development of this variant, each grid is covered by a second resistive coating having openings facing the microtips. In a further development of this variant, each grid rests on a second resistive coating having openings facing the microtips.

The resistive coating can be made from a material such as indium oxide, tin oxide or iron oxide. Preferably, the resistive coating is of doped silicon.

No matter which material is chosen, it must be ensured that the latter has a resistivity adapted to the homogenization and short-circuit protection effects. This resistivity generally exceeds $10^2$ Ωcm, whereas the resistivity of the cathode conductor is generally below $10^{-3}$ Ωcm.

If all the grids and cathode conductors have a grating structure, the meshes of the gratings preferably have the same dimensions.

BRIEF DESCRIPTION OF THE DRAWINGS

The invention is described in greater detail hereinafter relative to non-limitative embodiments and the attached drawings, wherein:

FIG. 1, already described and relating to the prior art, shows a microtip emissive cathode electron source;

FIG. 2, already described and relating to the prior art, diagrammatically shows a partial, sectional view of a microtip emissive cathode electron source;

FIG. 3, already described relating to the prior art, shows an electron emitter short-circuited with a grid;

FIG. 4 is a diagrammatic, partial, sectional view of a first embodiment of an electron source according to the invention;

DETAILED DESCRIPTION OF THE PREFERRED EMBODIMENTS

Figure 5:
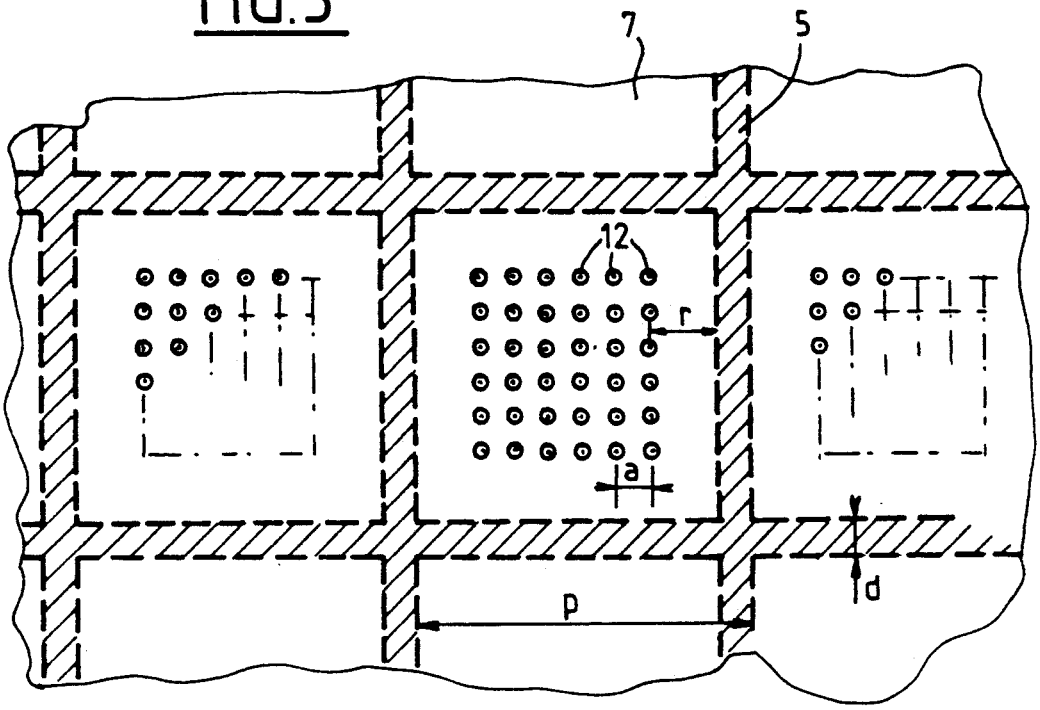
FIG. 5 is a diagrammatic, partial, plan view of the embodiment of FIG. 4.

With reference to FIGS. 4 and 5, a description will now be given of an electron source according to the invention. In this construction, the cathode conductors 5 have a grating-like structure. The meshes of the grating can have a random geometry. In the embodiments shown, the grating meshes are square. The spacing of the mesh p is approximately 50 micrometers and the width d of the conductive tracks forming the grating is approximately 5 micrometers. These conductive tracks are preferably metallic, for example, being made of Al, Mo, Cr, Nb or the like. A cathode conductor 5 has a width of 400 micrometers, the cathode conductors being separated from one another by a distance of approximately 50 micrometers. It is therefore clear that an intersection zone of a cathode conductor 5 and a grid 10 (of width 300 micrometers) covers several grating meshes. Under these conditions, each overlap zone of a cathode conductor 5 with a grid 10 consists of 48 meshes. The non-operation of a mesh due to short-circuits between the grid 10 and the microtips only disturbs the overall system in a proportion of 1/48, which has no significant effect.

The microtips 12 are brought together in the central zones of the meshes and are connected to the cathode conductor 5 by an e.g. doped silicon resistive coating 7. The distance a separating each microtip 12 can, for example, be 5 micrometers. The distance r separating the microtips 12 from the conductive tracks of the grating forming a cathode conductor 5 must be adequate to ensure that under normal operating conditions the voltage drop in the resistive coating 7 produces the aforementioned homogenization effect. As the doped silicon resistive coating 7 has a thickness of 0.5 micrometer, said distance r is at a minimum 5 micrometers for a voltage drop between 5 and 10 V under nominal operating conditions. For example, the distance r is 10 micrometers.

Each mesh contains a number n of microtips 12 with $$n=((p-d-2r)/a+1)^2.$$

In the represented embodiment, n is equal to 36.

In this embodiment, the access resistance of the cathode conductor 5 to all the microtips 12 is not very dependent on the size of the mesh and the number of microtips contained therein. It is essentially dependent on the resistivity and thickness of the resistive coating 7. For a silicon resistive coating, the resistivity p is approximately $3\times10^3$ ohm cm and its thickness e is, for example, 0.5 micrometer.

The access resistance R can be approximately calculated on the basis of the formula:

$$R=\frac{p}{2\pi e}$$

in which R is approximately $10^7$ ohms, which is adequate to obtain a voltage drop of approximately 10 V in the resistive coating 7.

Under these conditions, in the case of a short-circuit between an emitter 12 and the grid 10, the leakage current in a mesh is substantially equal to 10 microamperes, which is acceptable, because it does not deteriorate the operation of the electron source.

A process for producing such a device can, for example, involve the following stages:

a) On an e.g. glass insulating substrate 2 covered with a thin film 4 (of thickness 1000 Å) of $SiO_2$ is deposited, e.g. by cathode sputtering, a metal coating (thickness 2000 Å) e.g. of Nb.

b) A grating structure is produced in the metal coating, e.g. by photolithography and reactive ionic etching. Therefore, this structure is produced over the entire active surface of the electron source.

c) A resistive, doped silicon coating (thickness 5000 Å) is deposited e.g. by cathode sputtering.

d) The resistive coating and the metal coating are etched, e.g. by photogravure and reactive ionic etching, so as to form conductive columns (e.g. of width 400 micrometers and spaced apart by 50 micrometers).

e) The electron source is completed by producing an insulating layer, the grid and the microtips in accordance with the stages e.g. described in French patent 2 593 953 filed on the part of the present Applicant.

According to the invention, the microtips are only produced within the meshes. A positioning of the microtips with respect to the meshes of the cathode conductors is consequently necessary with an accuracy of approximately ±5 micrometers.

Figure 6:
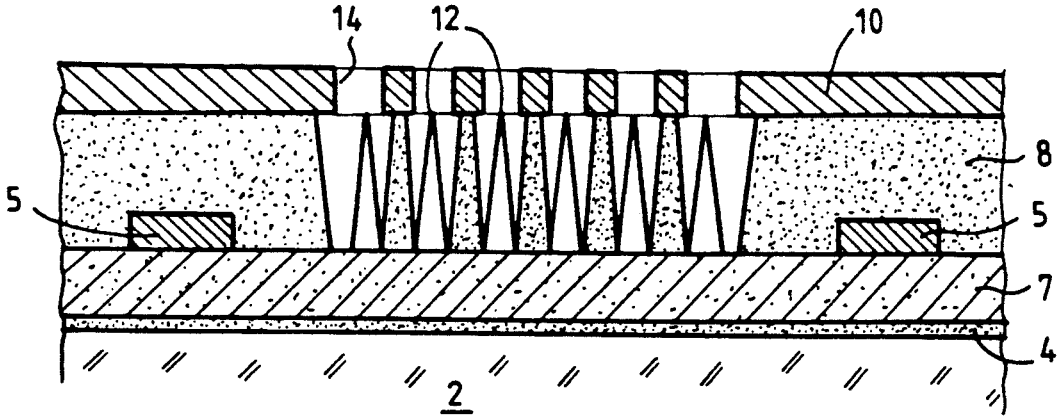
FIG. 6 is a diagrammatic view of another embodiment of the invention.

According to an embodiment diagrammatically shown in FIG. 6, the cathode conductors 5 have a grating structure resting on a resistive coating 7. In this configuration, a resistive coating 7 is consequently placed between the insulating support (more particularly the coating 4) and each cathode conductor 5.

Figure 7:
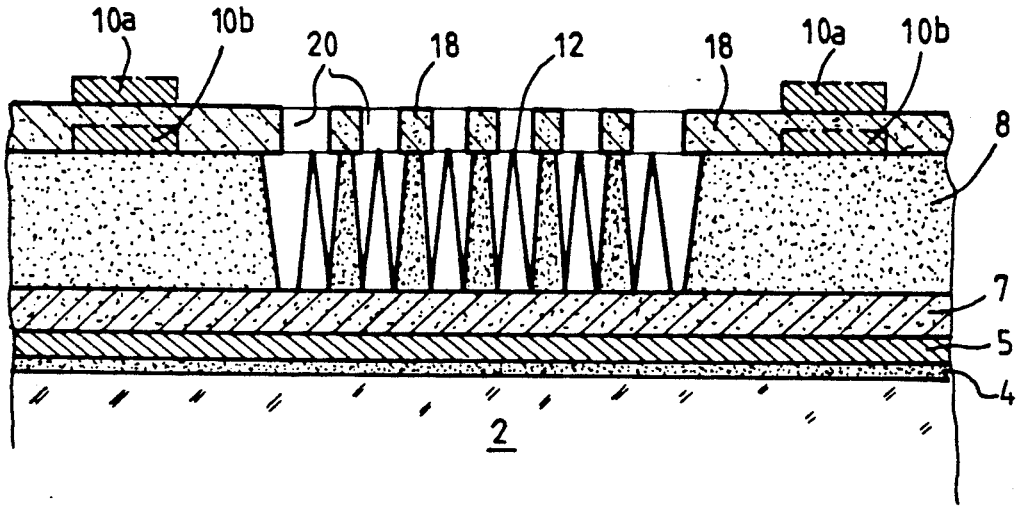
FIG. 7 is a diagrammatic view of another embodiment of the invention.

According to a variant shown in section in FIG. 7, the cathode conductors 5 no longer have a grating structure and instead the grids have such a structure.

According to a first embodiment, a second resistive coating 18, e.g. of doped silicon and having a resistivity of approximately $10^4$ ohm cm and a thickness of 0.4 micrometers, rests on the insulating layer 8. It has openings 20 for the passage of the microtips 12.

The grids 10*a* in the form of a grating with square meshes rests on the second resistive coating 18. The microtips 12 are placed within the central zone of the grating meshes.

According to a second embodiment, the second resistive coating 18 covers the grids 10*b*, which rest on the insulating layer 8.

In this variant, the grids can be of Nb and have a thickness of 0.2 micrometer. The width of each grid 10*a* or 10*b* can be 5 micrometers for a mesh spacing of 50 micrometers.

In both the first and second embodiments, the second resistive coating 18 provides a protection against short-circuits, the resistive coating 7 homogenizing the electron emission.

In this variant, the resistive coating 7 can be of doped silicon e.g. having a resistivity of $10^5$ ohm cm and a thickness of 0.1 micrometer. The cathode conductors 5 can e.g. be of ITO (tin-doped indium oxide).

Figure 8:
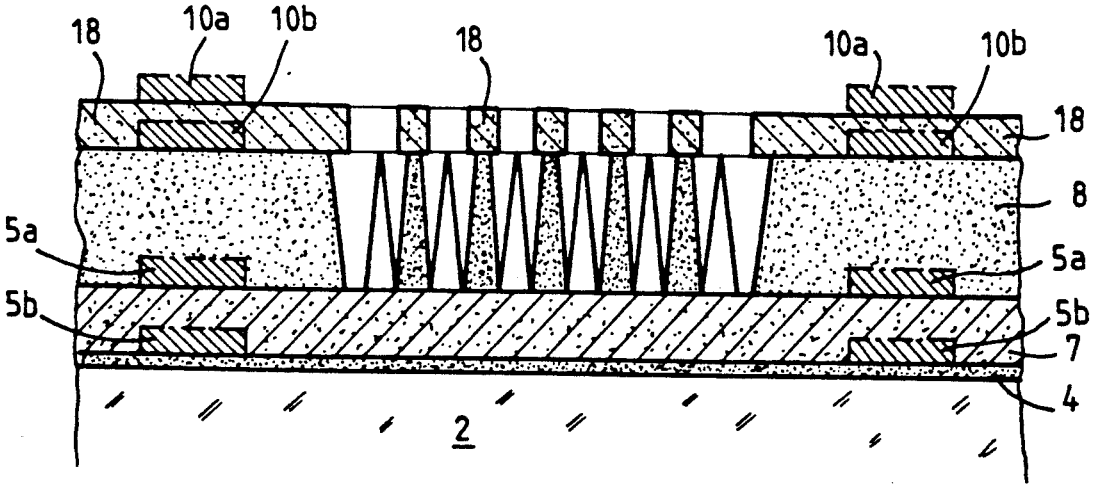
FIG. 8 is a diagrammatic view of another embodiment of the invention.

According to another variant diagrammatically shown in section in FIG. 8, the grids and cathode conductors have a square mesh grating structure. The meshes of the grids and the cathode conductors are then superimposed. The conductive tracks forming the meshes of the grids and the cathode conductors face one another in the overlap zones.

In the same way as hereinbefore, a second resistive coating 18 covers each grid 10*b* or the grids 10*a* can also cover the second resistive coating 10*a*.

With regards to the cathode conductors, the latter can be covered by the insulating layer 7 (cathode conductor 5*b*) or can cover the same (cathode conductor 5*a*).

Whichever variant is adopted, an electron source having grating-like electrodes makes it possible to reduce breakdown risks, while ensuring a good homogenization of the electron emission. The grating structure makes it possible to increase the access resistance of the microtips to the cathode conductors without increasing the thickness of the resistive coating.

I claim:

1. An electron source comprising, on an insulating support (2, 4), a first series of parallel electrodes serving as cathode conductors and carrying a plurality of microtips (12) made from an electron emitting material and a second series of parallel electrodes (10) serving as grids and which are electrically insulated from the cathode conductors (5) and forming an angle therewith, an area of overlap between said first and second series of electrodes defining an intersection zone of the cathode conductors (5) and the grids (10), the latter having openings (14) respectively facing the microtips (12), wherein the cathode conductors (5) have a grating structure, said grating structure being in contact with a resistive coating (7) and defining grating meshes, said microtips (12) occupying central regions of said grating meshes.

2. An electron source according to claim 1, wherein the size of each grating mesh is less than the size of the intersection zone.

3. An electron source according to claim 2, wherein the intersection zone covers several grating meshes.

4. An electron source according to claim 1, wherein the grating meshes are square.

5. An electron source according to claim 1, wherein each cathode conductor (5) is covered by the resistive coating (7).

6. An electron source according to claim 1, wherein the resistive coating (7) is inserted between the insulating support (2, 4) and each cathode conductor (5).

7. An electron source according to claim 5, wherein the resistive coating (7) is of doped silicon.

8. An electron source according to claim 6, wherein the resistive coating (7) is of doped silicon.

9. An electron source comprising, on an insulating support (2, 4), a first series of parallel electrodes serving as cathode conductors and carrying a plurality of microtips (12) made from an electron emitting material and a second series of parallel electrodes (10) serving as grids and which are electrically insulated from the cathode conductors (5) and forming an angle therewith, wherein the grids (10) have a grating structure, said grating structure being in contact with a resistive coating (18) and defining grating meshes, said microtips (12) occupying central regions of the grating meshes.

10. An electron source according to claim 9, wherein each grid (10) is covered by the resistive coating (18), said resistive coating having openings (20) facing the microtips (12).

11. An electron source according to claim 9, wherein each grid (10) rests on the resistive coating (18), said resistive coating having openings (20) facing the microtips (12).

12. An electron source according to claim 10, wherein the resistive coating (18) is of doped silicon.

13. An electron source according to claim 11, wherein the resistive coating (18) is of doped silicon.

14. An electron source comprising, on an insulating support (2, 4), a first series of parallel electrodes serving as cathode conductors and carrying a plurality of microtips (12) made from an electron emitting material and a second series of parallel electrodes (10) serving as grids and which are electrically insulated from the cathode conductors (5) and forming an angle therewith, wherein the grids (10) and the cathode conductors (5) each have a grating structure, each of said grating structures being in contact with a resistive coating (7, 18) and defining grating meshes, said microtips (12) occupying central regions of the grating meshes.

15. An electron source according to claim 14, wherein the grids (10) and cathode conductors (5) are covered by the resistive coating (7, 18) and the resistive coating (18) covering the grids (10) provides openings (20) facing the microtips (12).

16. An electron source according to claim 14, wherein the grid (10) rests on its resistive coating (18), the resistive coating (18) for the grid (10) having openings (20) facing the microtips (12), the resistive coating (7) for the cathode conductors (5) being inserted between the insulating support (2, 4) and the cathode conductor (5).

17. An electron source according to claim 16, wherein the resistive coatings (7, 18) are of doped silicon.

* * * * *